United States Patent [19]

Detzel et al.

[11] Patent Number: 4,605,129

[45] Date of Patent: Aug. 12, 1986

[54] CYLINDRICAL CONTAINER

[75] Inventors: Josef Detzel, Kempten; Franz Reitmeier, Sontheim; Remigius Heubuch, Dietmannsried, all of Fed. Rep. of Germany

[73] Assignee: Internationale Octrooi Maatschapij "Octropa" B.V., Rotterdam, Netherlands

[21] Appl. No.: 675,697

[22] Filed: Nov. 28, 1984

[30] Foreign Application Priority Data

Dec. 17, 1983 [DE] Fed. Rep. of Germany ..... 3345802

[51] Int. Cl.[4] ..... B65D 3/26

[52] U.S. Cl. ..... 206/623; 206/219; 220/307; 222/325

[58] Field of Search ..... 206/606, 623, 627, 219; 220/307; 222/325, 326, 327

[56] References Cited

U.S. PATENT DOCUMENTS

| | | | |
|---|---|---|---|
| 2,887,253 | 5/1959 | Biedenstein | 222/327 |
| 3,684,136 | 8/1972 | Baumann | 206/219 |
| 3,739,947 | 6/1973 | Baumann et al. | 206/219 |
| 3,756,390 | 9/1973 | Abbey et al. | 206/219 |
| 3,831,742 | 8/1974 | Gardella et al. | 206/219 |
| 4,136,775 | 1/1979 | Zaltsman | 206/219 |
| 4,515,267 | 5/1985 | Welsh | 206/219 |

FOREIGN PATENT DOCUMENTS

| | | | |
|---|---|---|---|
| 58989 | 9/1982 | European Pat. Off. | 222/327 |
| 1272816 | 7/1968 | Fed. Rep. of Germany . | |
| 3023835 | 1/1981 | Fed. Rep. of Germany . | |
| WO79/00758 | 10/1979 | PCT Int'l Appl. | 222/327 |
| 1538442 | 1/1979 | United Kingdom | 222/325 |

*Primary Examiner*—Joseph Man-Fu Moy

*Attorney, Agent, or Firm*—Cushman, Darby & Cushman

[57] ABSTRACT

A cylindrical container that has a lid with an opening for dispensing purposes as well as a piston-like base, which is pressed into the container in order to press out the contents of the container. The container body is wound from a flat, rectangular board blank and is closed by a longitudinal seam. Both ends of the body produced in this way are widened conically, in order to provide better sealing of the lid and base.

3 Claims, 3 Drawing Figures

CYLINDRICAL CONTAINER

BACKGROUND OF THE INVENTION

The invention relates to a cylindrical container with a lid incorporating an opening for dispensing purposes and a piston-like base as well as a body wound from a flat, rectangular blank made from board or similar material that is closed along a longitudinal seam.

In the case of a container in practical use the body is spirally wound from a strip of board to form a relatively stiff body, to which a lid and then after filling a piston-like base are fitted, the base being designed so that it can be pressed inside the body to press out the product. The body in particular is relatively expensive to produce by this process. In addition to this, these bodies take up a very great deal of space when they are delivered and stored.

SUMMARY OF THE INVENTION

The purpose of the invention is to create a container which avoids the disadvantages mentioned above, which can be produced at low cost and which takes up a minimum of space when it is not filled.

The way the present invention achieves this purpose is to widen the two ends of the body conically and to insert in these two ends the base and lid, the sides of which rest against the inside of the ends of the body and each of which has a U-shaped edge which the two ends of the body engage and to glue or seal the outer sections of the U-shaped edges to the outside of the body, the top of the U-shaped edge of the base having a line of weakening which extends all the way around the edge.

The result is a simply structured container, which is eminently suitable for storing and dispensing viscous substances in portions.

Insertion of the lid and base in widened ends of the body means that a good seal is guaranteed, so that the product can not escape. Additional sealing is also provided, since the ends of the body engage the U-shaped edges of the lid and base.

It is possible in accordance with the present invention that the sides of the base are cylindrical and have ribbing on the outside which extends in rings around the sides of the base.

This cylindrical design of the sides of the base leads to particularly effective sealing and facilitates the pressing in of the base. The ribbing improves the seal even more.

It is, however, also possible in accordance with the present invention for the sides of the base to be conical in shape.

Since the base is inserted in the body that has also been widened concially at the end, the body of the container is widened further when the base is pressed in further, which also leads to the production of a very effective seal. Here it is also possible to include additional ribbing on the outside of the base.

It is also very advantageous if in accordance with the present invention the middle sections of the lid and the base are designed to fit in each other.

This makes it possible to press the base into the body until it rests completely against the lid, so that all of the product can be pressed out.

In order to simplify the process of pressing out the product, it is proposed in accordance with the present invention that the middle section of the lid has an opening for dispensing purposes, into which a nozzle can be inserted.

BRIEF DESCRIPTION OF THE INVENTION

The drawing shows one embodiment of the invention:

DETAILED DESCRIPTION OF THE INVENTION

Figure 1:
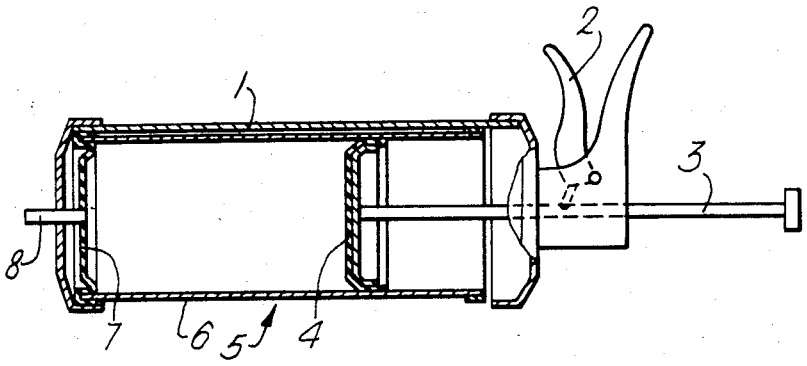
FIG. 1 shows a dispensing device and a container consisting of a cylindrical body as well as a base and a lid.

FIG. 1 shows a dispensing device 1 with a handle 2, which is connected to a piston rod 3 by a mechanism which is not shown in any further detail. When handle 2 is actuated, the piston rod 3 moves forwards and presses against base 4 of a cylindrical container 5. Container 5 has a tubular body 6, to the other end of which a lid 7 is attached. A nozzle 8 is inserted in this lid 7, through which the pasty product in container 5 escapes as soon as handle 2 is actuated.

Figure 2:
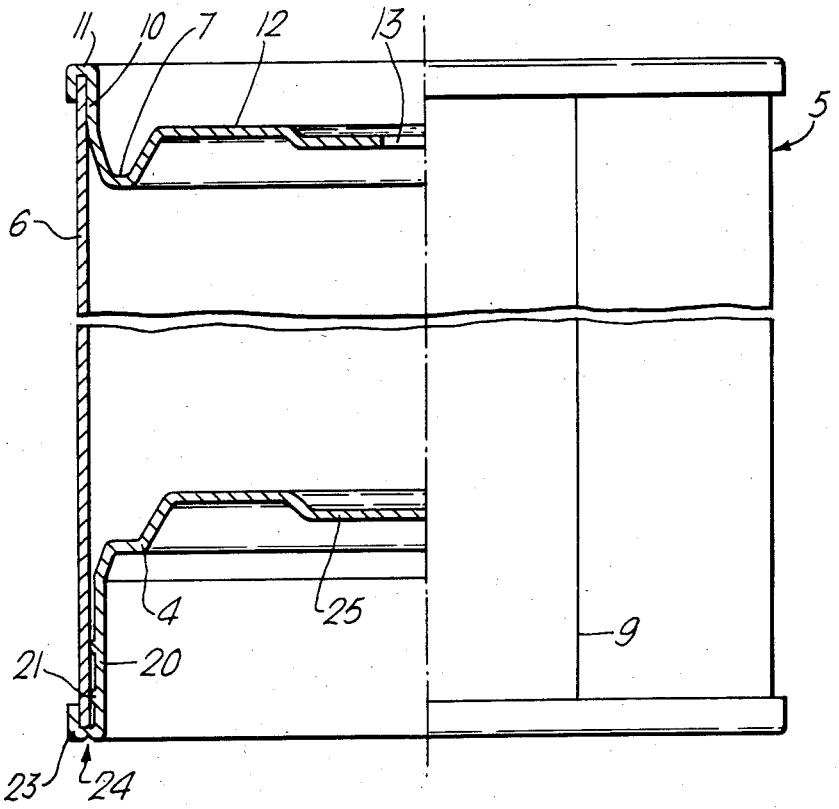
FIG. 2 shows the cylindrical container enlarged and partly cut open.
Figure 3:
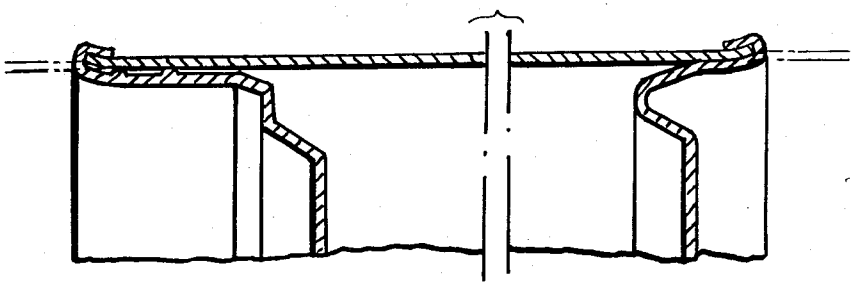
FIG. 3 shows a close-up view of the cylindrical container showing the concially widened end portion thereof.

FIG. 2 shows the structure of the cylindrical container 5. The body 6 is wound from a rectangular board blank and is closed by a longitudinal seam 9, which it is advisable to produce by sealing the two ends of the blank together. The two ends of the tubular body 6 produced in this way are widened to be slightly conical (see FIG. 3) and the base 4 and lid 7 are inserted into these widened ends.

The lid 7 has a concially shaped body 10, which is fitted into one of the widened ends of the container body. The lid 7 also has an edge 11 which is U-shaped in cross section, which the edge of the container body 6 engages and to which it is sealed. The middle section 12 of the lid 7 has an opening 13 in the center. The nozzle 8 can be inserted in this opening 13.

The base 4 also has a concially shaped body 20, which is fitted into one of the widened ends of the container body 6. The outside of the body 20 facing the container body 6 has two ribbing rings 21, 22, to provide a better seal. Adjacent to body 20 there is also a U-shaped edge 23, which is sealed to the outside of the container body. At the point where the concially shaped body 20 and the U-shaped edge 23 join there is a notch 24 that goes all the way round the base and that serves as a line of weakening so that these two parts of the base 4 can be torn apart. The middle section 25 of this base 4 fits into the middle section 12 of the lid 7, so that no gap is left between the base 4 and the lid 7 when the contents of the container are pressed out.

We claim:

1. A cylindrical container with a lid incorporating an opening for dispensing purposes and a piston-like base as well as a body wound from a flat, rectangular blank made from board or similar material that is closed along a longitudinal seam, said body having a body width wherein the two ends of the body are widened conically so as to be wider than said body width, and in these two ends the base and lid are inserted, the sides of which rest against the inside of the end of the body and each of which have a U-shaped edge which the two ends of the body engage and wherein the outer sections of the U-shaped edges are glued or sealed to the outside of the body, the portion of the U-shaped edge of the base which extends over the end of the body having a line of weakening which extends all the way around the edge at the end of the body so that the part of the U-shaped edge which is glued or sealed to the outside of the body may be separated around the line of weakening from the rest of the base when the base is moved inwardly towards the lid, the sides of the base being cylindrical and having ribbing on the outside which extends in rings around the sides of the base.

2. A cylindrical container according to claim 1, wherein the sides (20) of the base (4) are conical in shape.

3. A cylindrical container according to claim 1, or 2, wherein the middle sections (12,25) of the lid (7) and the base (4) are designed to fit in each other.

* * * * *